US007772940B2

(12) United States Patent
Mahon et al.

(10) Patent No.: US 7,772,940 B2
(45) Date of Patent: Aug. 10, 2010

(54) ROTATABLE POLARIZER DEVICE USING A HOLLOW DIELECTRIC TUBE AND FEED NETWORK USING THE SAME

(75) Inventors: John P. Mahon, Thousand Oaks, CA (US); Cynthia P. Espino, Carlsbad, CA (US)

(73) Assignee: Optim Microwave, Inc., Westlake Village, CA (US)

( * ) Notice: Subject to any disclaimer, the term of this patent is extended or adjusted under 35 U.S.C. 154(b) by 124 days.

(21) Appl. No.: 12/122,362

(22) Filed: May 16, 2008

(65) Prior Publication Data

US 2009/0284327 A1 Nov. 19, 2009

(51) Int. Cl.
*H01P 1/165* (2006.01)
*H01P 1/18* (2006.01)

(52) U.S. Cl. ..... 333/21 A; 333/157

(58) Field of Classification Search ..... 333/21 A, 333/126, 129, 134, 135, 137, 157, 159
See application file for complete search history.

(56) References Cited

U.S. PATENT DOCUMENTS

| | | | | |
|---|---|---|---|---|
| 2,716,221 | A * | 8/1955 | Allen | 333/159 |
| 2,783,439 | A * | 2/1957 | Whitehorn | 333/159 |
| 3,164,789 | A * | 1/1965 | Grosbois et al. | 333/137 |
| 4,613,836 | A * | 9/1986 | Evans | 333/159 |
| 4,806,945 | A * | 2/1989 | Cormier et al. | 343/756 |
| 4,951,010 | A | 8/1990 | Grim | |
| 5,376,905 | A | 12/1994 | Kich | |
| 6,166,610 | A | 12/2000 | Ramanujam | |
| 6,297,710 | B1 | 10/2001 | Cook | |
| 6,677,911 | B2 | 1/2004 | Moheb | |
| 7,236,681 | B2 | 6/2007 | Moheb | |

* cited by examiner

*Primary Examiner*—Benny Lee
(74) *Attorney, Agent, or Firm*—SoCal IP Law Group LLP; Mark A. Goldstein; John E. Gunther

(57) ABSTRACT

There is disclosed a feed network including a circular common waveguide having an axis and terminating in a common port and a first port for coupling a first linearly polarized mode to the circular common waveguide. A phase shifting element may be disposed within the circular waveguide. The phase shifting element may be adapted to cause a predetermined phase shift between a first signal and a second signal propagating in the common waveguide. The phase shifting element may be rotatable about the axis of the common waveguide.

26 Claims, 10 Drawing Sheets

Section A-A

ROTATABLE POLARIZER DEVICE USING A HOLLOW DIELECTRIC TUBE AND FEED NETWORK USING THE SAME

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to rotatable polarizer devices for use in cylindrical waveguides.

Description of the Related Art

Satellite broadcasting and communications systems, such as Ku band very small aperture terminal (VSAT) communications systems, may use orthogonally polarized signals within the same frequency band for the uplink to and downlink from satellites.

A common form of antenna for transmitting and receiving signals from satellites consists of a parabolic dish reflector and a feed network where orthogonally polarized modes travel in a circular waveguide. Note that the term "circular" refers to the cross-sectional shape of the waveguide. An ortho-mode transducer may be used to launch or extract the orthogonal linearly polarized modes into or from the circular waveguides.

An ortho-mode transducer (OMT) is a three-port waveguide device having a common waveguide coupled to two branching waveguides. Within this description, the term "port" refers generally to an interface between devices or between a device and free space. A port may include an interfacial surface, an aperture in the interfacial surface to allow microwave radiation to enter or exit a device, and provisions to mount or attach an adjacent device.

The common waveguide of an OMT typically supports two orthogonal linearly polarized modes. Within this document, the terms "support" and "supporting" mean that a waveguide will allow propagation of a mode with little or no loss. In a feed system for a satellite antenna, the common waveguide may be a circular waveguide. The two orthogonal linearly polarized modes may be $TE_{11}$ modes which have an electric field component orthogonal to the axis of the common waveguide. When the circular waveguide is partially filled with a dielectric material, the two orthogonal linearly polarized modes may be hybrid $HE_{11}$ modes which have at least some electric field component along the propagation axis. Two precisely orthogonal $TE_{11}$ or $HE_{11}$ modes do not interact or cross-couple, and can therefore be used to communicate different information.

The common waveguide terminates at a common port aperture. The common port aperture is defined by the intersection of the common waveguide and an exterior surface of the OMT.

Each of the two branching waveguides of an OMT typically supports only a single linearly polarized $TE_{10}$ mode. The mode supported by the first branching waveguide is orthogonal to the mode supported by the second branching waveguide. Within this document, the term "orthogonal" will be used to describe the polarization direction of modes, and "normal" will be used to describe geometrically perpendicular structures.

A satellite communications system may use a linearly polarized signal for the uplink to the satellite and an orthogonally polarized signal for the downlink from the satellite. The polarization directions for the uplink and downlink signals may be determined by the antenna and feed network on the satellite. To ensure maximum coupling of the signals to and from the satellite, each terrestrial antenna may include provisions to adjust the polarization directions of the uplink and downlink signals to exactly match the polarization directions defined at the satellite. In present antennas, the polarization directions of the uplink and downlink signals may be adjusted by rotating the entire antenna or by rotating all or portions of the feed network including the OMT. In either case, the item being rotated is heavy and the cables connecting to the feed network must be repositioned.

DESCRIPTION OF THE DRAWINGS

Elements in the drawings are assigned reference numbers which remain constant between the figures. An element not described in conjunction with a figure may be presumed to be the same as an element having the same reference number described in conjunction with a previous figure.

FIGS. 4A, 6, and 7 include dimensions defining a specific exemplary embodiment of a rotatable polarizing device. The specific embodiment is intended for use in the Ku frequency band from 13.75 GHz to 14.5 GHz, and was designed to satisfy a specific set of requirements. The specific embodiment is intended for use with a cylindrical waveguide having an inner diameter (WGID in FIG. 4A) of 0.526 inch. These dimensions are provided as a representative example of a rotatable polarizing device. Other embodiments of a rotatable polarizing device intended for use in other frequency bands and for other applications may have significantly different dimensions and are included in the disclosure herein.

DETAILED DESCRIPTION

Description of Apparatus

Figure 1:
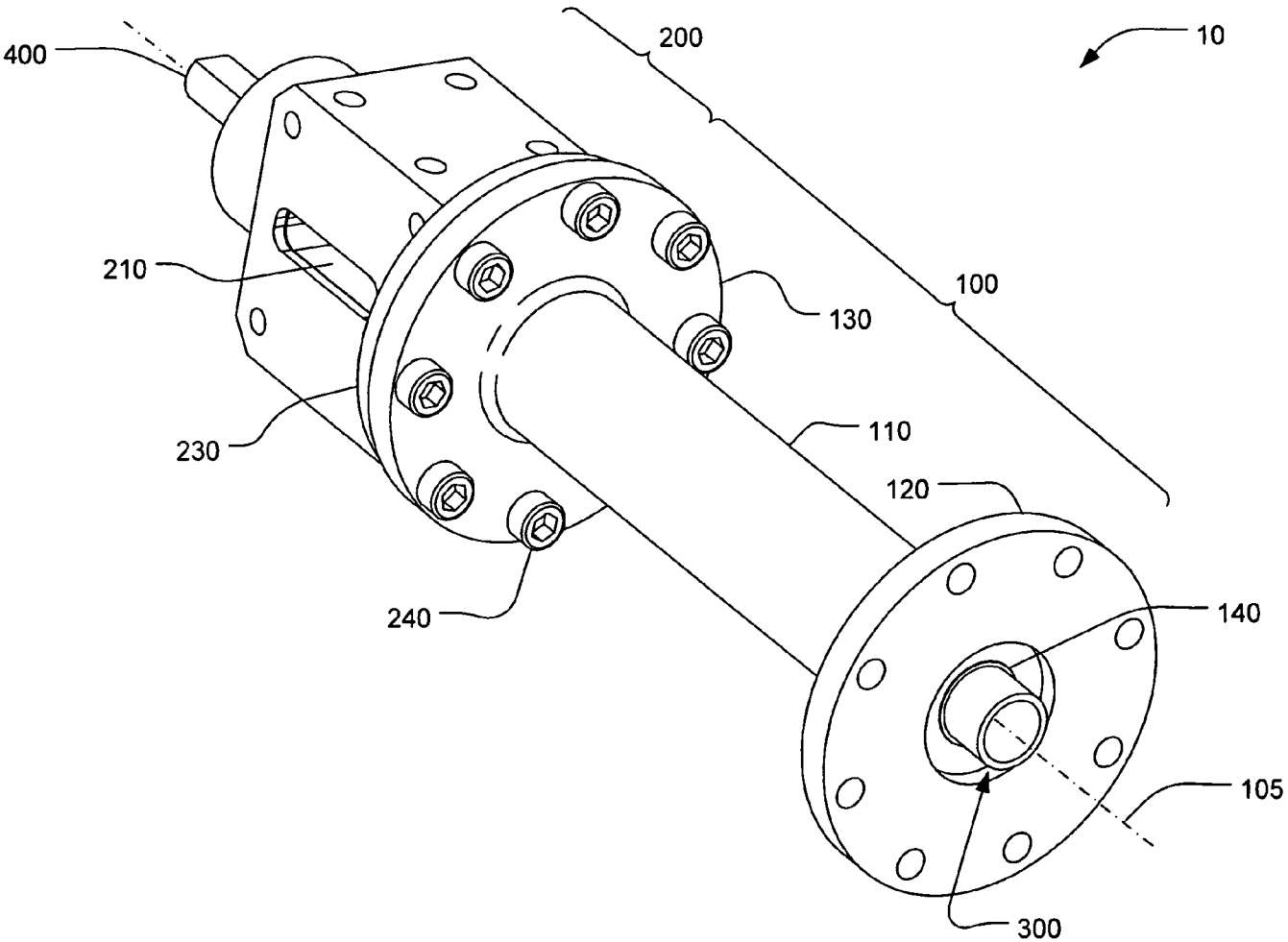
FIG. 1 is a perspective view of an exemplary feed network including a rotatable phase shifting element.

Referring now to FIG. 1, an exemplary feed network 10, which may be a feed network for a Ku band antenna such as a VSAT antenna, may include an ortho-mode transducer (OMT) 200 coupled to a cylindrical waveguide 100. The cylindrical waveguide 100 may include a cylindrical tube 110. A first flange 120 and a second flange 130 may be disposed at the ends of the cylindrical tube 110 to facilitate attaching the cylindrical waveguide to adjacent waveguide components. The opening at the end of the cylindrical tube 110 proximate to the first flange 120 may define a common output port 140.

The OMT 200 may include a first port 210 for coupling a first $HE_{11}$ mode into or from the cylindrical waveguide 100. In applications where orthogonally polarized signals are used to communicate different information, the OMT 200 may include a second port, not visible in FIG. 1, for coupling a second $HE_{11}$ mode into or from the cylindrical waveguide 100. A polarization direction of the first $HE_{11}$ mode may be orthogonal to a polarization direction of the second $HE_{11}$ mode. Where both ports are present, the first and second ports may be referred to as the "vertical" port and the "horizontal" port, respectively. However, the terms "vertical" and "horizontal" do not imply any absolute orientation of the OMT 200 or the feed network 10.

The OMT 200 may include a common port flange 230. The common port flange 230 may be coupled to the second flange 130 of the cylindrical waveguide 100 using bolts 240. The flanges 120, 130, and 230 and the bolts 240 are representative of typical feed network structures. However, the OMT 200 and the cylindrical waveguide 100 may be fabricated as a single piece, or may be coupled by soldering, bonding, welding, or other method not requiring the use of the flanges 130 and 230 and/or the bolts 240.

A rotatable phase shifting element 300 may be disposed within the cylindrical waveguide 100. In FIG. 1, the only portion of the rotatable phase shifting element 300 that is visible is a cylindrical tubular portion extending from the common mode port 140. The rotatable phase shifting element 300 may extend through the cylindrical waveguide 100 and the OMT 200 and may be coupled to a shaft 400 extending outside of the OMT 200. The shaft 400 and the rotatable phase shifting element 300 may be adapted to be rotatable about an axis 105 of the cylindrical waveguide.

Figure 2:
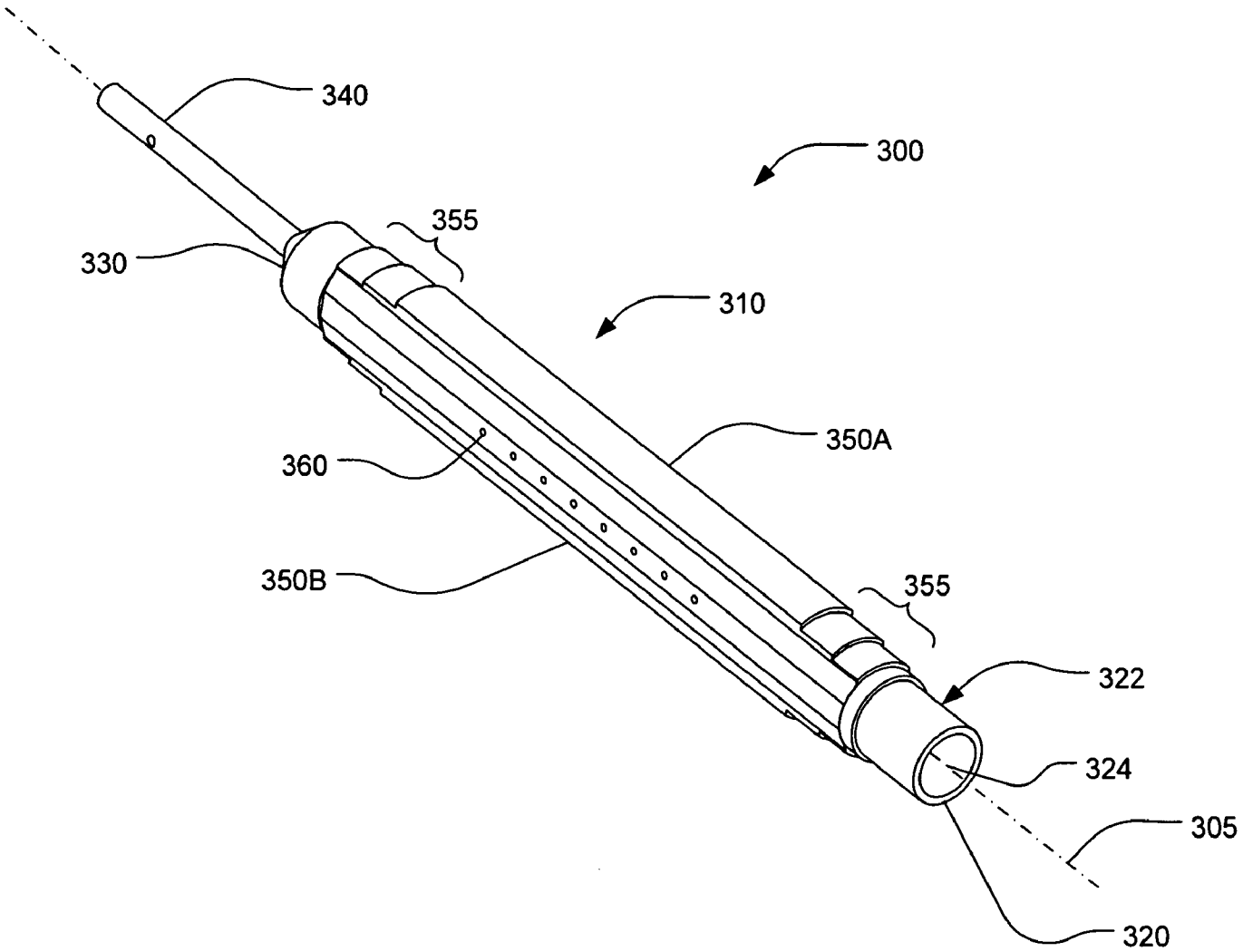
FIG. 2 is a perspective view of an exemplary rotatable phase shifting element.

FIG. 2 shows a perspective view of an exemplary phase shifting element 300 at approximately the same scale and orientation as the phase shifting element within the feed network 10 shown in FIG. 1. The phase shifting element 300 may include an elongated tube 310 extending from a first end 320 to a second end 330. The elongated tube 310 may be hollow by virtue of a cylindrical bore 324 extending longitudinally from the first end 320. The cylindrical bore 324 may extend through nearly the entire length of the elongated tube. The second end 330 of the elongated tube may be at least partially closed. An adjustment stem 340 may extend from the closed second end 330. The adjustment stem 340, the elongated tube 310 and the cylindrical bore may be coaxial about an axis 305, which may correspond to the axis 105 shown in FIG. 1.

The use of the elongated hollow tube 310 to support the diametrically opposed fins 350A, 350B may improve the bandwidth of the feed network by avoiding resonances. Resonances may occur if a $TM_{01}$ mode can propagate within a section of the feed network. The $TM_{01}$ mode and the associated resonances may be excited by a propagating $HE_{11}$ mode if there are asymmetries in the manufacture of the rotatable phase shifting element or other components of the feed network.

In a partially filled cylindrical waveguide, such as the cylindrical waveguide 100 which is partially filled by the dielectric rotatable phase shifting element 300, the cutoff frequency of the $TM_{01}$ mode is usually higher than the cutoff frequency of $HE_{11}$ modes. The useful bandwidth of a partially filled cylindrical waveguide may be approximately the difference between the cutoff frequencies of the $TM_{01}$ mode and the $HE_{11}$ modes. The cylindrical waveguide 100 and the rotatable phase shifting element 300 may be designed such that the cutoff frequency of the $TM_{01}$ mode is higher than a required operational frequency band for the feed network. Thus resonances of the $TM_{01}$ mode cannot occur since the $TM_{01}$ mode cannot propagate in the cylindrical waveguide 100 at frequencies within the operational frequency band.

Adding dielectric material, such as the rotatable phase shifting element 300, into a waveguide generally lowers the cutoff frequencies of modes propagating in the waveguide compared to the cutoff frequencies of similar modes propagating in an unfilled waveguide. However, since a $TM_{01}$ mode has a substantial electric field along the axis of a cylindrical waveguide, adding dielectric material near the axis of a cylindrical waveguide may have a greater effect on the cutoff frequency of the $TM_{01}$ mode than on the cutoff frequency of the $HE_{11}$ modes. Thus adding dielectric material near the axis may reduce the difference between the cutoff frequencies of the $TM_{01}$ and $HE_{11}$ modes, and substantially reduce the bandwidth of the waveguide compared to the bandwidth of an unfilled waveguide. On the other hand, adding dielectric material in the form of a hollow tube may have a lesser effect on the cutoff frequency of the $TM_{01}$ mode relative to the cutoff frequency of the $HE_{11}$ modes. Thus a phase shifting element in the form of a hollow tube may provide increased bandwidth compared to other forms of phase shifting elements.

A pair of diametrically opposed fins 350A, 350B may extend radially from the elongated tube 310. The diametrically opposed fins 350A, 350B may rise from the elongated tube 310 in a series of steps 355. When the phase shifting element 300 is disposed within a cylindrical waveguide (as in FIG. 1), the steps may be effective in providing a smooth impedance transition.

The rotatable phase shifting element 300 may be formed with a plurality of pilot holes 360 along both sides of the elongated tube 310 between the diametrically opposed fins 350A, 350B. The pilot holes 360 may conveniently allow a portion of the material of the elongated tube 310 to be removed by drilling at least some of the pilot holes to a larger diameter. As will be described subsequently, material may be removed from the elongated tube for the purpose of adjusting the performance of the rotatable phase shifting element 300.

The rotatable phase shifting element 300 may be fabricated from a low-loss polystyrene plastic material such as REXOLITE® (available from C-LEC Plastics) or another The rotatable phase shifting element 300 may be fabricated from a low-loss polystyrene plastic material such as REXOLITE® cross-linked polystyrene (available from C-LEC Plastics) or another dielectric material suitable for use at the frequency of operation of the rotatable phase shifting element 300. The rotatable phase shifting element 300 may be machined from a single piece of dielectric material, or may comprise multiple pieces of dielectric material attached together with adhesive bonding or other technique. The rotatable phase shifting element 300 may also be fabricated by casting or injection molding or by a combination of molding and machining operations.

Figure 3A:
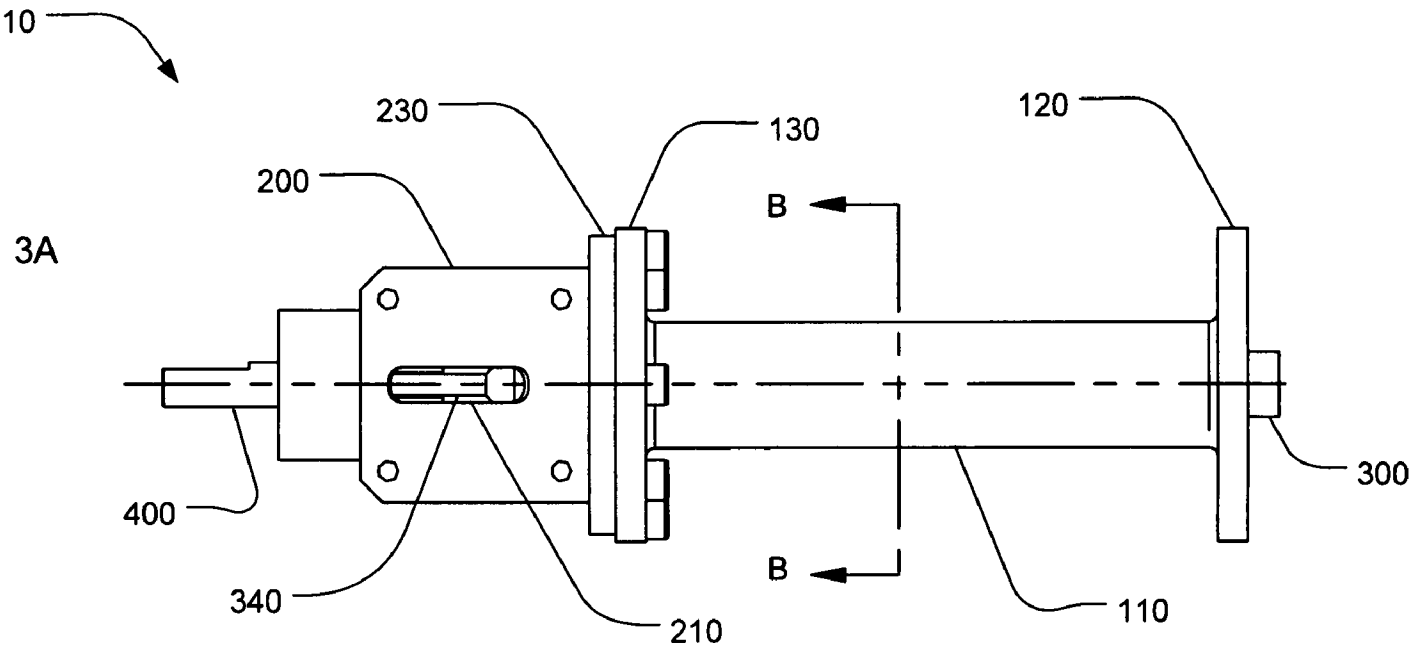
FIG. 3A is a top view of the exemplary feed network of FIG. 1.
Figure 3B:
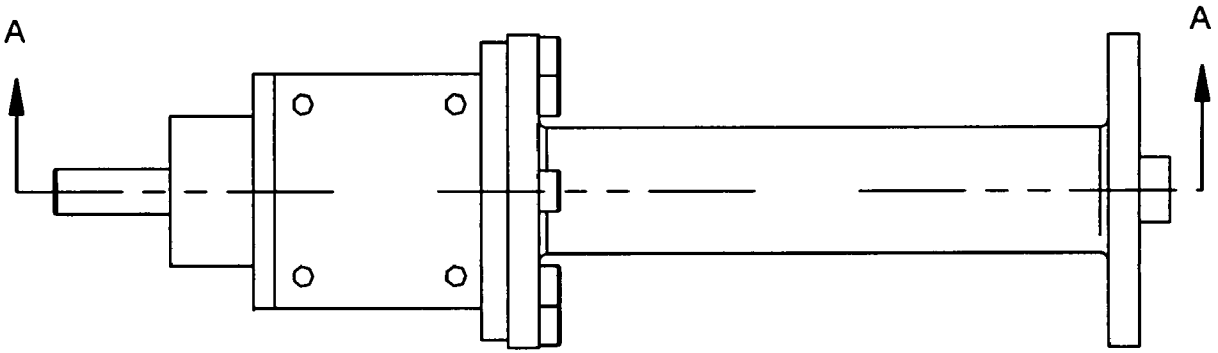
FIG. 3B is a side view of the exemplary feed network of FIG. 1.

FIG. 3A and FIG. 3B show top and side views, respectively, of the feed network 10 of FIG. 1 including the cylindrical waveguide tube 110, the OMT 200, flanges 120, 130, 230, and the shaft 400. The adjustment stem 340 of the rotatable phase shifting element 300 is also visible through the vertical port 210 of the OMT 200. FIG. 3A and FIG. 3B define two section planes A-A and B-B that will be shown in subsequent figures.

Figure 4B:
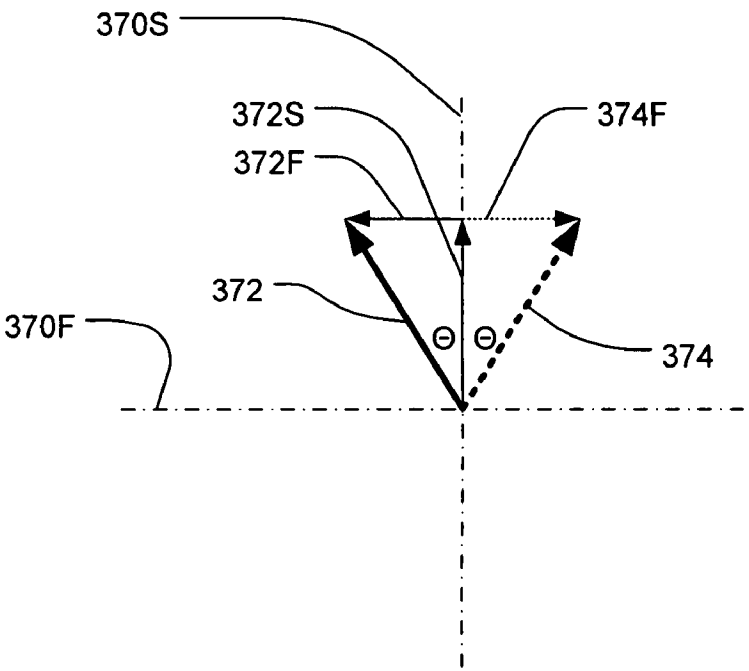
FIG. 4B is a vector diagram illustrating the effect of a 180-degree phase shifting element.
Figure 4A:
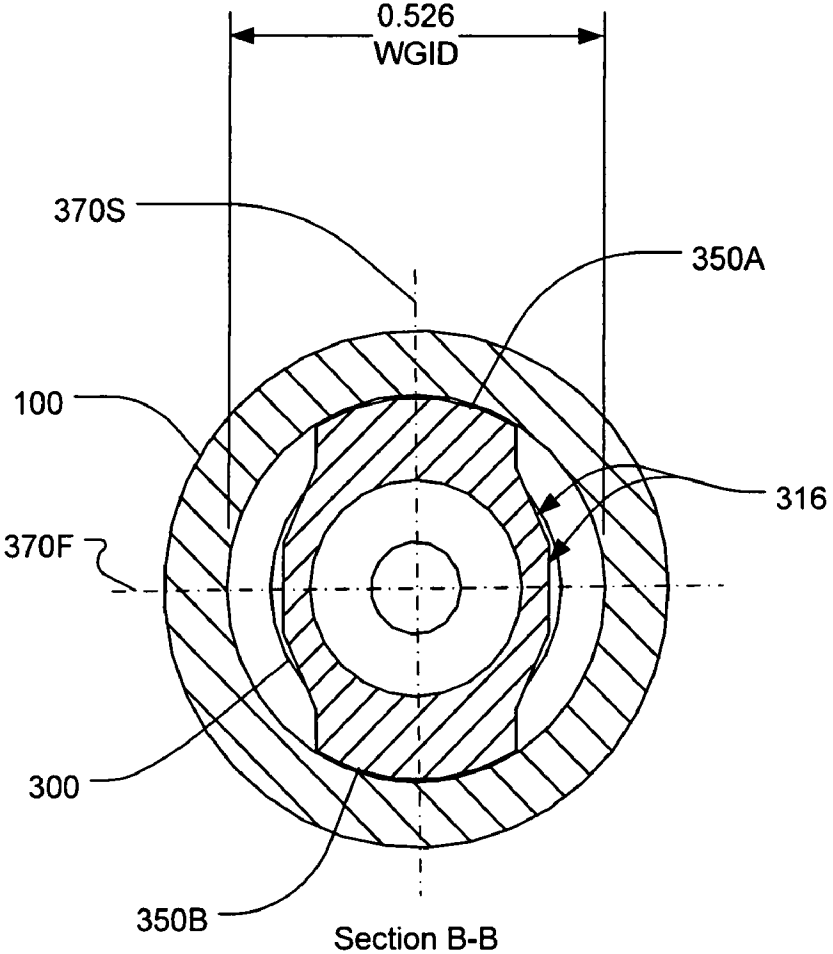
FIG. 4A is a transverse cross-sectional view of an exemplary feed network.

FIG. 4A shows transverse cross-sectional view of the feed network 10 at the section plane B-B (defined in FIG. 3). Since the rotatable phase shifting element 300, including the diametrically opposed fins 350A, 350B is not rotationally symmetrical with the cylindrical waveguide 100, the rotatable phase shifting element 300 may introduce relative phase shifts to signals propagating through the cylindrical waveguide. Specifically, a first $HE_{11}$ mode polarized along a plane 370S bisecting the diametrically opposed fins 350A, 350B may be phase-shifted with respect to a second $HE_{11}$ mode polarized along a plane 370F orthogonal to the plane 370S. Planes 370S and 370F may be referred to as the "slow" and "fast" planes of the polarizing device, respectively. The rotatable phase-shifting element 300 may be symmetric about both the slow plane 370S and the fast plane 370F.

The outside surface of the rotatable polarizing element 300 adjacent to the diametrically opposed fins 350A, 350B may be a plurality of flat faces 316 rather than a continuous cylindrical or curved surface. A plurality of flat faces 316 may be less costly to machine than a continuous cylindrical surface. In the example of FIG. 4A, the outside surface of the rotatable polarizing element 300 adjacent to the diametrically opposed fins 350A, 350B is formed as a total of six flat faces, three on each side of the rotatable polarizing element. The outside surface may include fewer or more than six flat faces.

The phase shifting element 300 may be designed to introduce a nominal phase shift, between signals polarized along the fast and slow planes, of 180 degrees, 90 degrees, or some other value. The phase shifting element 300 may be designed to provide an essentially constant phase shift over a predetermined frequency band. In this patent, the word "essentially" means "equal to within an acceptable tolerance". The value of an acceptable tolerance may depend on the specific requirements of an application.

As illustrated in FIG. 4B, a phase shifting element providing a phase shift of essentially 180 degrees may be used to rotate the polarization direction of a linearly polarized mode traveling through a cylindrical waveguide such as the cylindrical waveguide 100. An incident linearly polarized mode, depicted by arrow 372, may have a polarization axis that forms an angle $\Theta$ with the slow axis 370S of a phase shifting element. The incident mode may be considered as the vector sum of a component 372S along the slow axis 370S and a component 372F along the fast axis 370F of the phase shifting element. The phase shifting element may provide a relative phase shift of essentially 180 degrees, which effectively reverses the direction of one component of the incident wave. After the 180-degree phase shift, the propagating mode, represented by dotted vector 374, is the vector sum of components 372S and 374F (which is component 372F phase-shifted by 180 degrees). Thus the effect of the 180 degree phase shifting element is to rotate the polarization direction of the mode by an angle of $2\Theta$. Rotating the phase shifting element will cause the polarization direction of the mode to be changed by an angle twice as large as the angle of rotation of the phase shifting element. Thus rotating a phase shifting element within a feed network provides a method of rotating the polarization direction of an antenna without rotating the feed network or the entire antenna and without relocating cables.

A phase shifting element providing a phase shift of essentially 90 degrees is commonly used to convert a linearly polarized mode into or from a circularly polarized mode. A rotatable phase shifting element providing a phase shift of essentially 90 degrees may be used as a switch to selectably convert a linearly polarized mode to one of an unchanged linearly polarized mode, a left-hand circularly polarized mode, or a right-hand circularly polarized mode.

Figure 5:
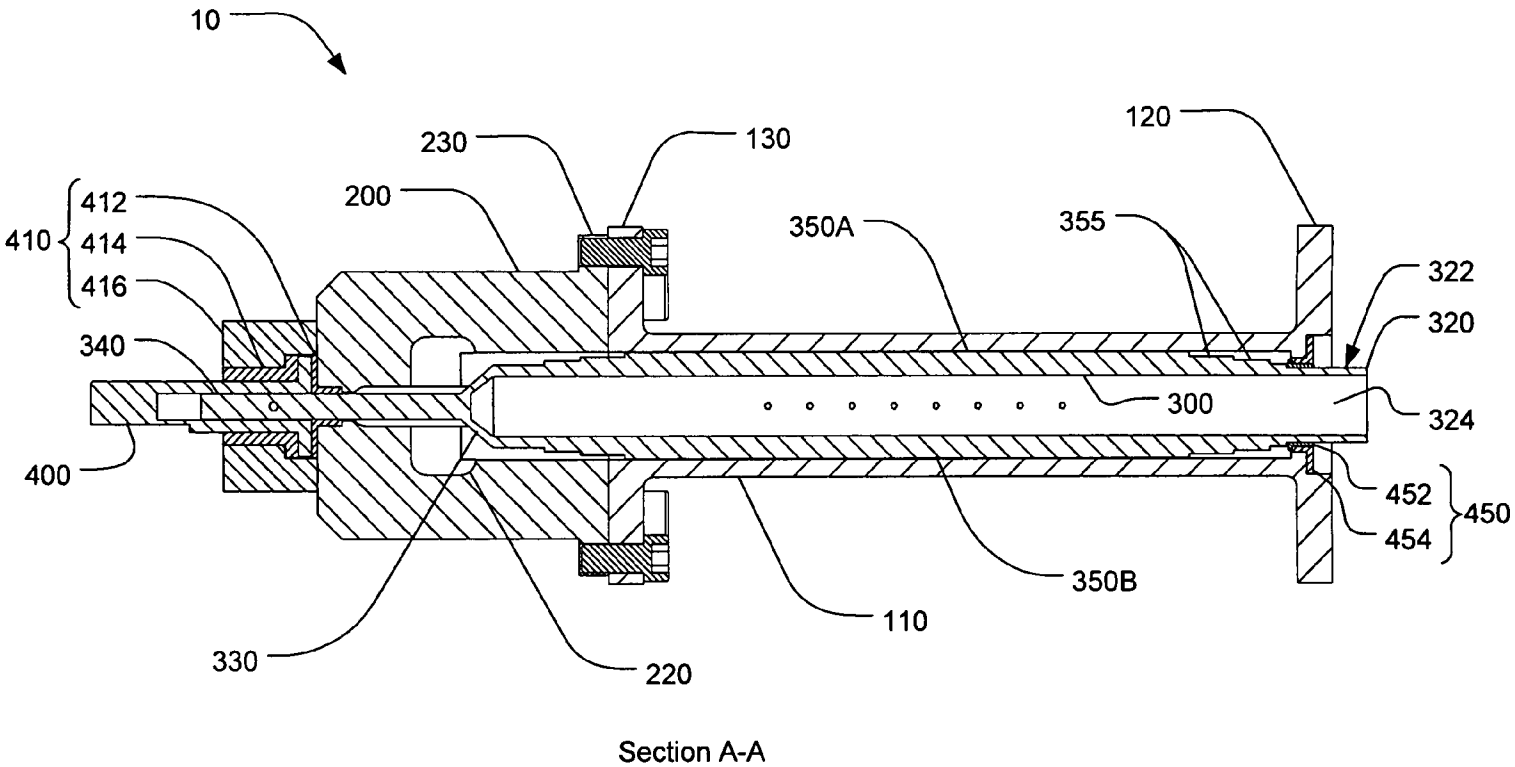
FIG. 5 is a longitudinal cross-sectional view of an exemplary feed network.

FIG. 5 shows a longitudinal cross-sectional view of the feed network 10 along the plane A-A (defined in FIG. 3) including the cylindrical waveguide tube 110, the OMT 200 including the horizontal port 220, flanges 120, 130, 230, and the shaft 400. A phase shifting element 300 is shown rotated such that the slow plane (370S in FIG. 4) is aligned with the section plane A-A such that the diametrically opposed fins 350A, 350B, including steps 355, are cut by the section plane.

The first end 320 of the rotatable phase shifting element may have a cylindrical outside surface 322. The cylindrical surface 322 may be rotatable within a first bearing 450. Within this patent, the term "bearing" means any mechanism that allows rotary motion about a fixed axis. In the example of FIG. 5, the first bearing 450 may consist of a bushing 452 retained by a metal or dielectric ring 454. The bushing 452 may be made of, or coated with, TEFLON® (polytetrafluoroethylene) or other fluorinated polymer, graphite, ceramic, or other material having a smooth and/or slippery surface.

The adjustment stem 340 may be coupled to the shaft 400 using a pin, key or other mechanism (not visible). The adjustment stem 340, the shaft 400, or both the adjustment stem 340 and the shaft 400 may be rotatable within a second bearing 410. In the example of FIG. 5, the second bearing 410 may consist of an inner bushing 412 and an outer bushing 414 which are retained by a cap 416. The bushings 412 and 414 may also be made of TEFLON® or other material having a smooth and/or slippery surface.

The use of bushings 452, 412, and 414 in the feed network 10 of FIG. 5 is exemplary. When justified by the mechanical requirements of the feed network 10, either or both of the first bearing 450 and the second bearing 410 may be a roller bearing, ball bearing, or other type of bearing.

Figure 6:
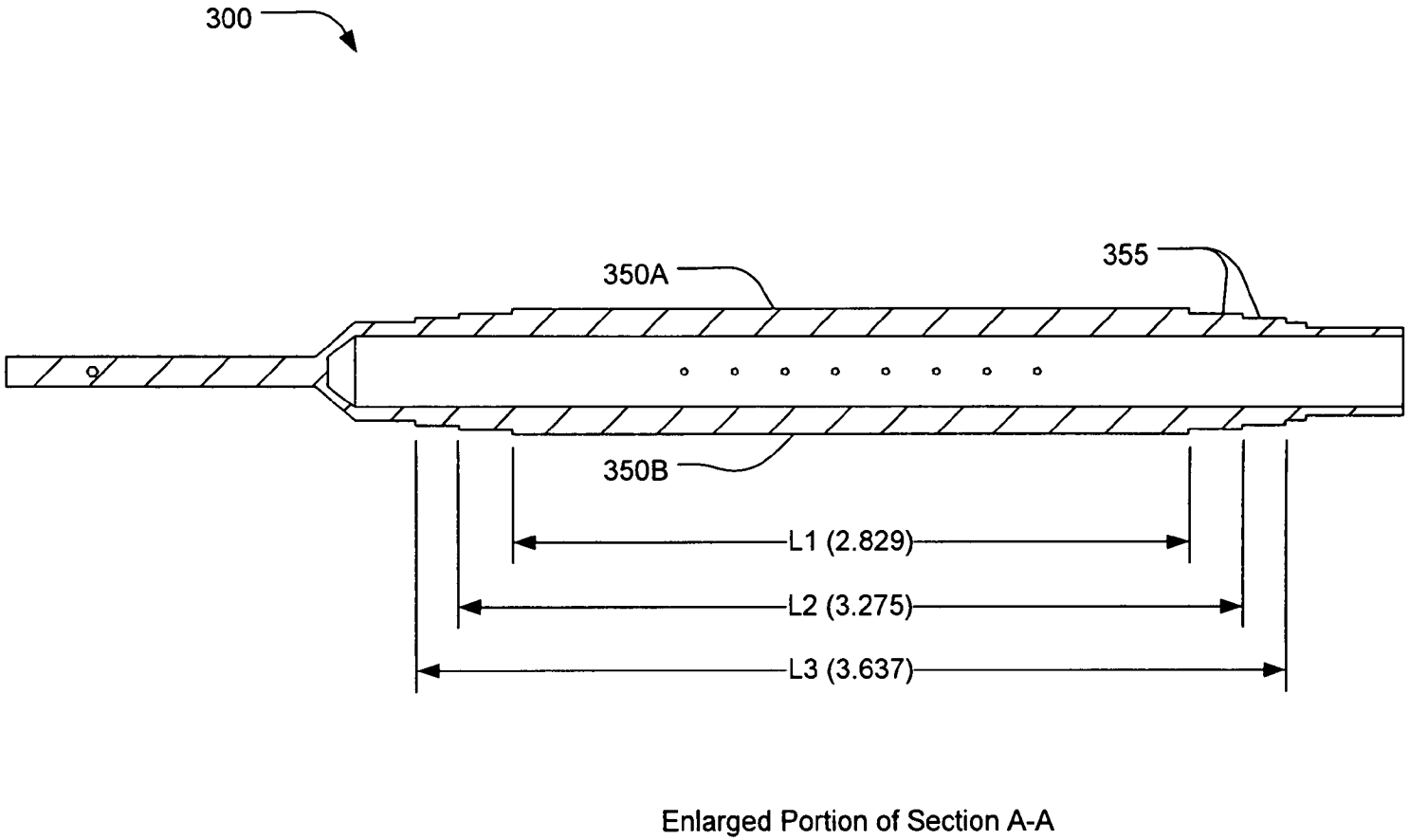
FIG. 6 is a longitudinal cross-sectional view of an exemplary rotatable phase shifting element.
Figure 7:
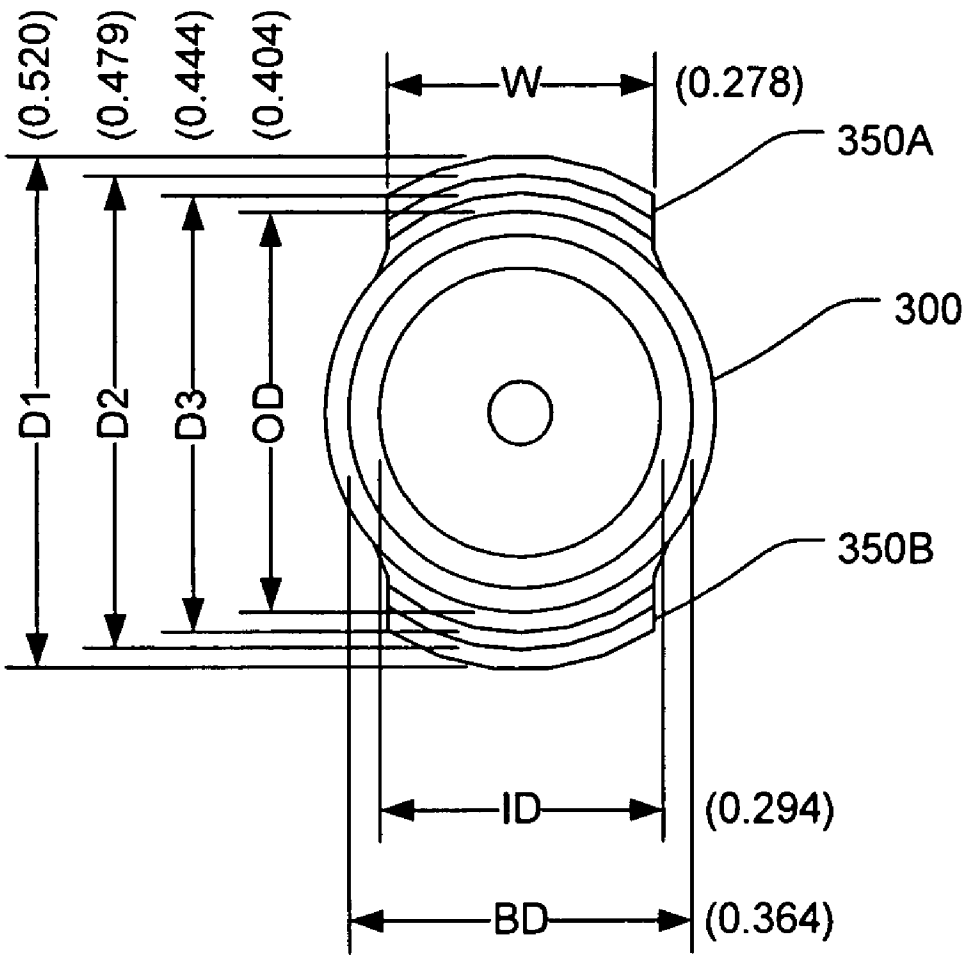
FIG. 7 is an end view of the exemplary rotatable phase shifting element.

FIG. 6 and FIG. 7 are a longitudinal cross-sectional view and an end view, respectively, of an exemplary rotatable phase shifting element 300. FIG. 6 shows an enlarged portion of the cross section A-A previously shown in FIG. 5. FIG. 6 provides exemplary dimensions for the length L1 of a central portion of the diametrically opposed fins 350A, 350B. FIG. 6 also provides overall length dimensions L2 and L3 for the stepped portions 355 of the diametrically opposed fins. In the example of FIG. 6, L1, L2, and L3 are equal to 2.829, 3.275, and 3.637 inches, respectively. FIG. 7 provides exemplary dimensions D1, D2, D3 for the outside diameters of the stepped and central portions of the diametrically opposed fins. In the example of FIGS. 7, D1, D2, and D3 are equal to 0.520, 0.479, and 0.444 inches, respectively. FIG. 7 also provides exemplary dimensions for the width W of the diametrically opposed fins, the outside diameter OD of the elongated hollow tube portion 310 of the rotatable phase shifting element 300, the outside diameter BD of the portion of the elongated hollow tube (322 in FIG. 2) that passes through the first bearing, and the inside diameter ID of the central bore (324 in FIG. 2) of the elongated hollow tube. In the example of FIG. 7, W, OD, BD, and ID are equal to 0.278, 0.404, 0.0.364, and 0.294 inches, respectively.

Figure 8B:
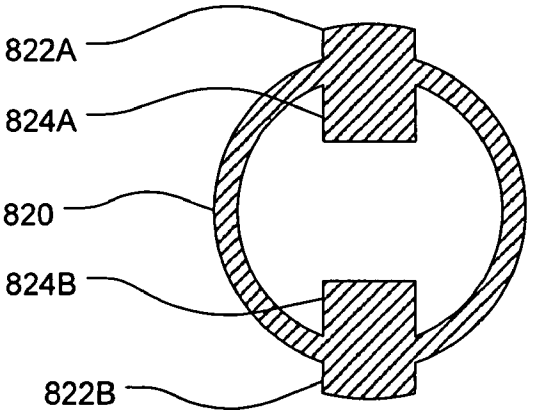
FIG. 8B is a transverse cross-sectional view of another exemplary rotatable phase shifting element.
Figure 8C:
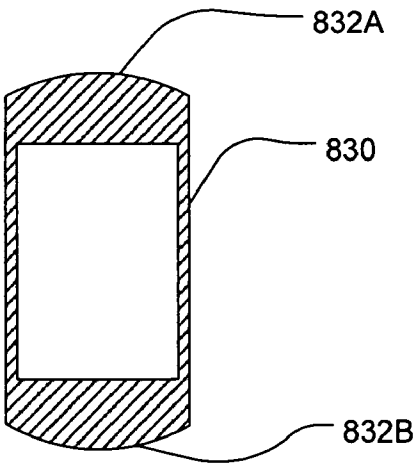
FIG. 8C is a transverse cross-sectional view of another exemplary rotatable phase shifting element.
Figure 8A:
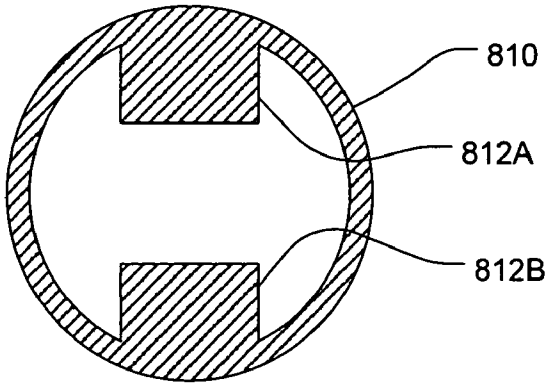
FIG. 8A is a transverse cross-sectional view of another exemplary rotatable phase shifting element.

The exemplary rotatable phase shifting element 300 shown in FIG. 2 and FIGS. 4-7 included diametrically opposed fins 350A, 350B extending outwardly from an elongated hollow tube 310 having a generally circular cross section. However, as shown in FIG. 8A, a rotatable phase shifting element may have diametrically opposed fins 812A, 812B that extend inwardly from an elongated tubular portion 810. As shown in FIG. 8B, a rotatable phase shifting element may include an elongated tubular portion 820 supporting diametrically opposed fins having outwardly extending portions 822A, 822B and inwardly extending portions 824A, 824B.

Except for the portions that rotate within bearings, the cross-sectional shape of a rotatable phase shifting element may not be circular. As shown in the example of FIG. 8C, a rotatable phase shifting element may include a generally rectangular hollow tube 830 with two thickened walls 832A, 832B. A rotatable phase shifting element may have any cross-sectional shape adapted to provide the desired predetermined relative phase shift between two orthogonal linearly polarized modes.

A feed network, such as the feed network 10, and/or a rotatable phase shifting element, such as the rotatable phase shifting element 300, may be designed by using a commercial software design tool such as CST Microwave Studio. An initial model of a feed network including a rotatable phase shifting element may be generated. The dimensions and relative positions of the initial model may be selected to satisfy basic operating requirements. For example, the dimensions of an OMT may be selected such that the horizontal and vertical ports each support a single $TE_{10}$ mode that can be coupled into two orthogonal $HE_{11}$ modes supported in a cylindrical common waveguide. The modeled structure may then be analyzed over the desired operating frequency band. Performance parameters, such as the reflection coefficients and isolation of the vertical, horizontal, and common ports, may be determined from the analysis. The dimensions of the model may be optimized to achieve performance objectives, such as minimizing the reflection coefficients and maximizing the isolation of the dominant modes at each of the three ports. The optimization may be achieved using multiple iterations of the model performed manually or automatically using the software design tool.

The dimensions of the phase shifting element may be selected to set the desired phase shift, to prevent coupling of higher order modes, to minimize reflection coefficients and/or to maximize isolation between the orthogonal $HE_{11}$ modes. The dimensions may be selected manually or automatically using the software design tool. The dimensions of the phase shifting element that may be optimized include the cylindrical waveguide inner diameter WGID, the lengths (L1, L2, L3) of the segments of the diametrically opposed fins, the diameters (D1, D2, D3) of the segments of the diametrically opposed fins, the inside and outside diameters of the body of the phase shifting element (ID, OD), and other dimensions.

The dimensions of the specific exemplary embodiment given in FIGS. 4, 6, and 7 may be suitable, if scaled in proportion to frequency, as the initial dimensions for the design of rotatable phase shifting elements for other frequency bands or applications. The final dimensions and relative proportions of a rotatable phase shifting element for another frequency band and/or application may be substantially different from the dimensions given in FIGS. 4, 6, and 7.

Figure 9:
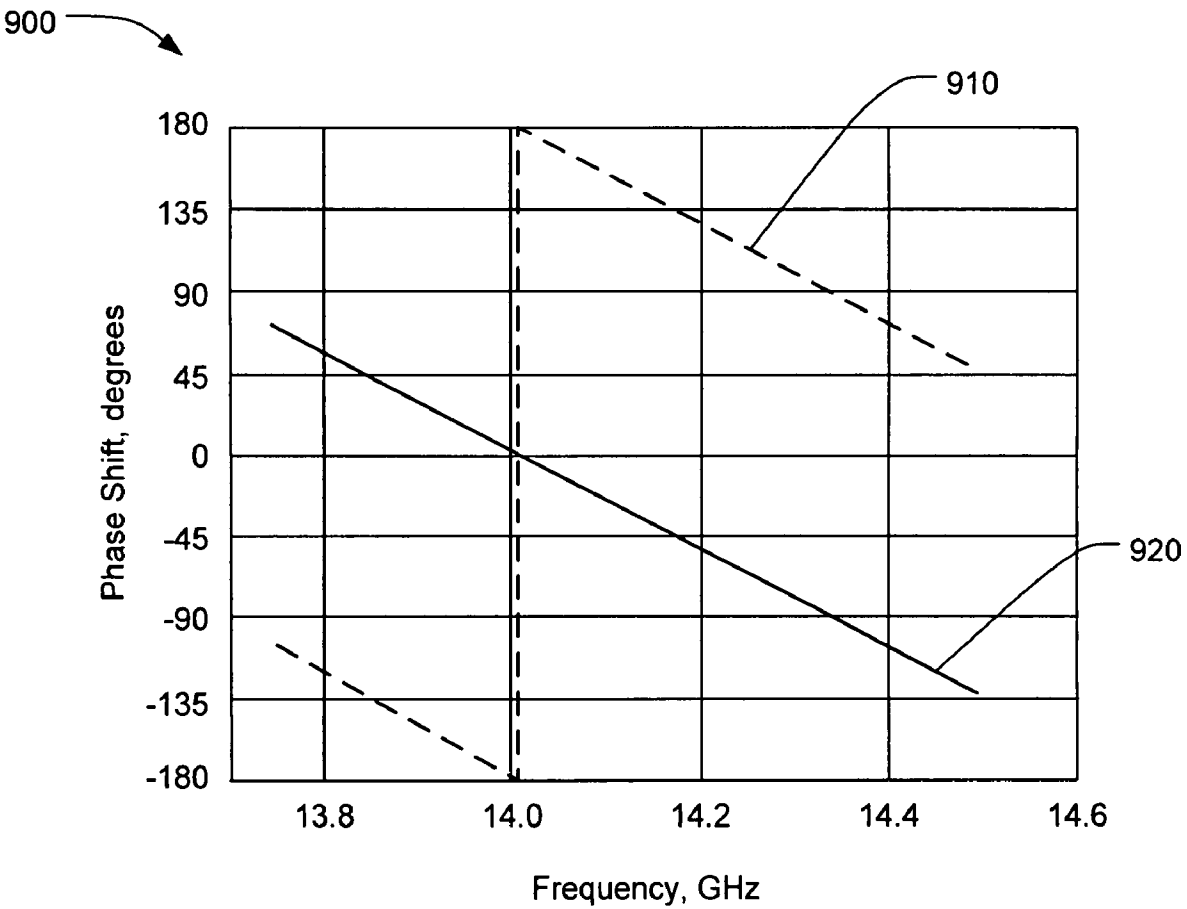
FIG. 9 is a graph showing the simulated performance of an exemplary rotatable phase shifting element.

FIG. 9 shows a graph 900 illustrating the simulated performance of a 180-degree phase shift rotatable phase shifting element similar to the rotatable phase shifting element 300. The performance of the rotatable phase shifting element was simulated using finite integral time domain analysis. The time-domain simulation results were Fourier transformed into frequency-domain data as shown in FIG. 9. The dashed line 910 and the solid line 920 plot the phase shift introduced by the phase shifting element in two orthogonal linearly polarized $HE_{11}$ modes. The difference between the phase shifts of the two orthogonal linearly polarized $HE_{11}$ modes is essentially constant at 180 degrees over a frequency band from 13.75 GHz to 14.5 GHz.

During manufacture of a rotatable phase shifting element, such as the rotatable phase shifting element 300, the rotatable phase shifting element may be mounted in a cylindrical waveguide of an appropriate diameter. The phase shift introduced by the rotatable phase shifting element may then be measured. The phase shift introduced by the rotatable phase shifting element may then be adjusted by drilling one or more diametrically opposed pairs of pilot holes (360 in FIG. 2) to remove small amounts of dielectric material from the rotatable phase shifting element.

Figure 10:
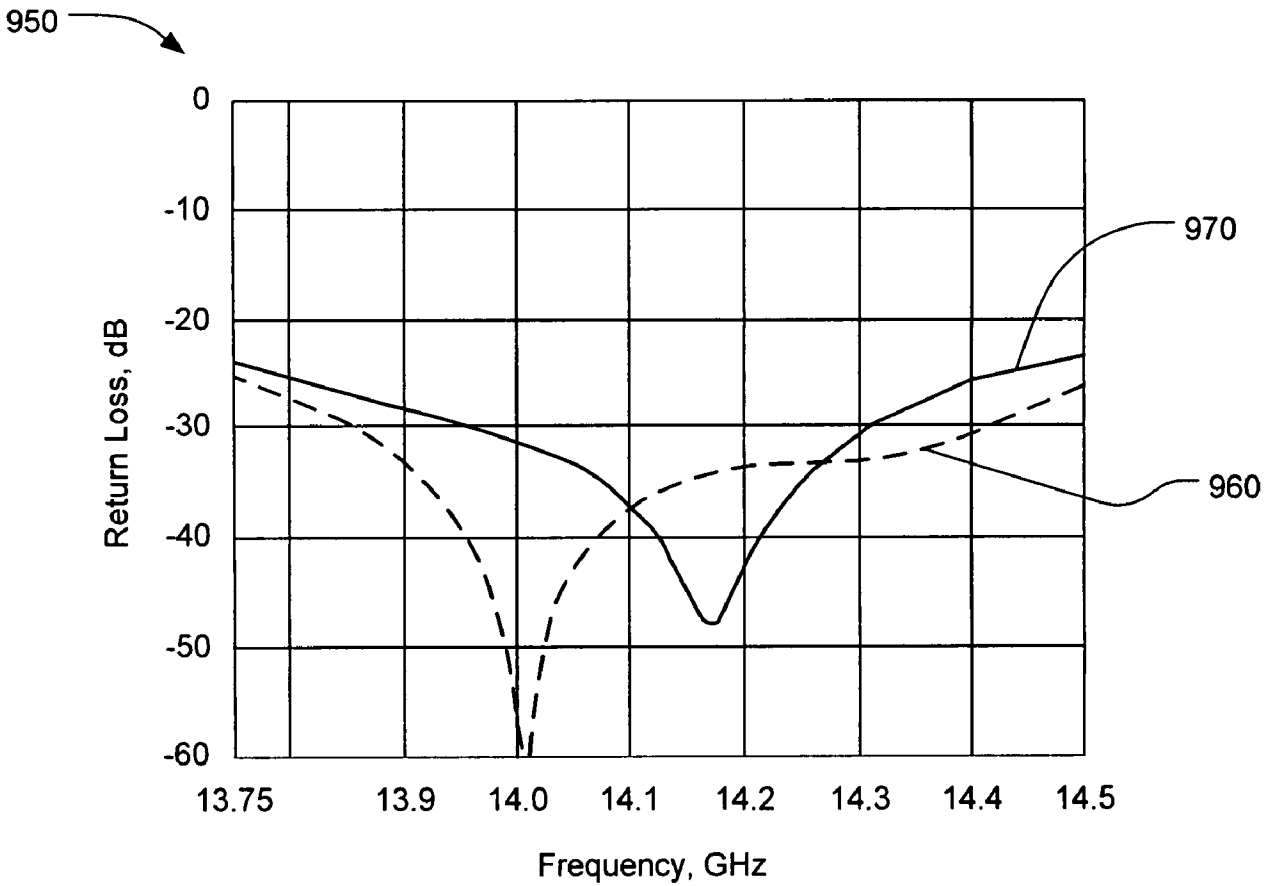
FIG. 10 is a graph showing the simulated performance of an exemplary rotatable phase shifting element.

FIG. 10 is another graph 950 illustrating the simulated performance of a 180-degree phase shift rotatable phase shifting element similar to the rotatable phase shifting element 300. The dashed line 960 and the solid line 970 plot the return loss introduced by the rotatable phase shifting element 300 to the two orthogonal linearly polarized $HE_{11}$ modes. The return loss is less than −23 dB over a frequency band from 13.75 GHz to 14.5 GHz.

Closing Comments

Throughout this description, the embodiments and examples shown should be considered as exemplars, rather than limitations on the apparatus and procedures disclosed or claimed. Although many of the examples presented herein involve specific combinations of apparatus elements, it should be understood that those acts and those elements may be combined in other ways to accomplish the same objectives. Elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A feed network comprising:

a circular common waveguide having an axis and terminating in a common port a first port for coupling a first linearly polarized mode to the circular common waveguide a phase shifting element disposed within the circular waveguide, the phase shifting element comprising an elongated hollow dielectric tube coaxial with the circular common waveguide wherein the phase shifting element is adapted to cause a predetermined relative phase shift between a first signal and a second signal propagating in the common waveguide, and wherein the phase shifting element is rotatable about the axis of the common waveguide.

2. The feed network of claim 1, further comprising:

a second port for coupling a second linearly polarized mode to the circular common waveguide, the second linearly polarized mode orthogonal to the first linearly polarized mode.

3. The feed network of claim 1, wherein the predetermined relative phase shift is essentially 90 degrees.

4. The feed network of claim 1, the phase shifting element further comprising:

diametrically opposed fins extending from the dielectric tube.

5. The feed network of claim 4, wherein the dielectric fins extend outward from the dielectric tube.

6. The feed network of claim 5, wherein the dielectric fins extend outward from the dielectric tube in a series of steps.

7. The feed network of claim 4 wherein the dielectric fins are bisected by a first plane containing the axis of the common waveguide.

8. The feed network of claim 7, wherein the dielectric fins are symmetrical about the first plane and about a second plane normal to the first plane.

9. The feed network of claim 7, wherein the first and second signals each have a frequency within a predetermined frequency band, and the first signal is polarized parallel to the first plane and the second signal is polarized orthogonal to the first plane.

10. The feed network of claim 1, wherein the predetermined relative phase shift is essentially 180 degrees.

11. The feed network of claim 1, wherein the phase shifting element further comprises an adjustment stem coaxial with the common waveguide the phase shifting element may be rotated about the axis by rotating the adjustment stem.

12. The feed network of claim 11, further comprising:

a shaft coaxial with and coupled to the adjustment stem wherein the phase shifting element may be rotated about the axis by rotating the shaft.

13. The feed network of claim 12, wherein an end of the phase shifting element remote from the adjustment stem is rotatable within a first bearing the adjustment stem and/or the shaft are rotatable within a second bearing.

14. The feed network of claim 13, where the first bearing and the second bearing each comprise one or more bushings.

15. A feed network comprising:

a circular common waveguide having an axis and terminating in a common port a first port for coupling a first linearly polarized mode to the circular common waveguide a phase shifting element disposed within the common waveguide, the phase shifting element including an adjustment stem coaxial with the common waveguide a shaft coaxial with and coupled to the adjustment stem wherein an end of the phase shifting element remote from the adjustment stem is rotatable within a first bearing and the adjustment stem and/or the shaft are rotatable within a second bearing, wherein the phase shifting element is adapted to cause a predetermined relative phase shift between a first signal and a second signal propagating in the common waveguide, and wherein the phase shifting element may be rotated about the axis of the common waveguide by rotating the shaft.

16. The feed network of claim 15, where the first bearing and the second bearing each comprise one or more bushings.

17. A phase shifting element for use in a circular waveguide, comprising:

an elongated hollow dielectric tube having an axis wherein the phase shifting element is adapted to cause a predetermined relative phase shift between a first signal and a second signal propagating in the circular waveguide.

18. The phase shifting element of claim 17, wherein the predetermined relative phase shift is essentially 90 degrees.

19. The phase shifting element of claim 17, further comprising:

dielectric fins extending from the dielectric tube.

20. The phase shifting element of claim 19, wherein the dielectric fins are bisected by a first plane containing the axis of the dielectric tube.

21. The phase shifting element of claim 19, wherein the dielectric fins are symmetrical about the first plane and about a second plane normal to the first plane.

22. The phase shifting element of claim 19, wherein the dielectric fins extend outward from the dielectric tube.

23. The phase shifting element of claim 22, wherein the dielectric fins extend outward from the dielectric tube in a plurality of steps.

24. The phase shifting element of claim 17, further comprising:

an adjustment stem coupled to an end of the dielectric tube, the adjustment stem coaxial with the dielectric tube.

25. The phase shifting element of claim 17, wherein the phase shifting element is formed with pilot holes to allow adjustment of the relative phase shift.

26. The phase shifting element of claim 17, wherein the predetermined relative phase shift is essentially 180 degrees.

* * * * *